US008235756B2

(12) United States Patent
Stiehl

(10) Patent No.: US 8,235,756 B2
(45) **Date of Patent: *Aug. 7, 2012**

(54) LOW PROFILE PLUGS

(75) Inventor: Kurt Stiehl, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/092,575

(22) Filed: Apr. 22, 2011

(65) Prior Publication Data

US 2011/0195612 A1 Aug. 11, 2011

Related U.S. Application Data

(63) Continuation of application No. 12/211,034, filed on Sep. 15, 2008, now Pat. No. 7,950,967.

(60) Provisional application No. 61/094,734, filed on Sep. 5, 2008, provisional application No. 61/011,587, filed on Jan. 18, 2008.

(51) Int. Cl.
*H01R 24/04* (2006.01)

(52) U.S. Cl. ..... 439/669

(58) Field of Classification Search ..... 439/668, 439/669

See application file for complete search history.

(56) References Cited

U.S. PATENT DOCUMENTS

| | | | | |
|---|---|---|---|---|
| 1,536,068 | A | | 5/1925 | Bohlman |
| 1,722,739 | A | | 7/1929 | Ford |
| 1,837,754 | A | | 12/1931 | Calmus |
| 2,444,997 | A | | 7/1948 | Lovesey |
| 2,520,739 | A | | 8/1950 | Shaw |
| 2,632,788 | A | | 3/1953 | Ustin |
| 2,857,581 | A | | 10/1958 | Henning |
| 3,656,089 | A | * | 4/1972 | Bailey ..... 439/482 |
| 5,090,921 | A | | 2/1992 | van der Laar |
| 5,409,403 | A | | 4/1995 | Falossi et al. |
| 6,439,933 | B1 | | 8/2002 | Moji |
| 6,616,487 | B1 | | 9/2003 | Lai |
| 7,553,195 | B2 | | 6/2009 | Matsumoto et al. |
| 7,682,201 | B2 | | 3/2010 | Chen et al. |
| 7,771,240 | B2 | | 8/2010 | Lynch et al. |
| 7,833,055 | B2 | | 11/2010 | Crooijmans et al. |
| 2007/0178771 | A1 | | 8/2007 | Goetz et al. |

FOREIGN PATENT DOCUMENTS

| | | |
|---|---|---|
| EP | 1898499 | 3/2008 |

* cited by examiner

*Primary Examiner* — Neil Abrams
(74) *Attorney, Agent, or Firm* — Kramer Levin Naftalis & Frankel LLP

(57) ABSTRACT

Apparatus, systems, and methods for assembling a plug with a low profile for use with an electronic device are provided. In some embodiments, a 4-pin plug may include a diameter similar to the diameter of a 3-pin plug. In some embodiments, the fourth pin may be coupled to the plug such that a portion of the fourth pin may be coupled to any suitable device on an internal surface of the plug. In some embodiments, the fourth pin may dive into the plug at the same depth as one of the other three pins of the plug. The pins within the plug may be coupled (e.g., soldered) at the ends that may emerge underneath an overmold to any other suitable device to form electrical connections. The plug may be used to transmit audio or transfer data to a user of the electronic device.

45 Claims, 5 Drawing Sheets

LOW PROFILE PLUGS

CROSS-REFERENCE TO RELATED APPLICATION

This application is a continuation of co-pending, commonly-assigned U.S. Nonprovisional patent application Ser. No. 12/211,034, filed Sep. 15, 2008, which claims the benefit of prior filed U.S. Provisional Application No. 61/011,587, filed Jan. 18, 2008, and prior filed U.S. Provisional Application No. 61/094,734, filed Sep. 5, 2008, each of which is incorporated by reference herein in its entirety.

FIELD OF THE INVENTION

This can relate to apparatus, systems, and methods for assembling a plug with a low profile for use with an electronic device.

BACKGROUND OF THE DISCLOSURE

Electronic devices provide audio or other types of data to a user of the electronic device using different approaches, including through an accessory device (e.g., a headset) that includes a 3-pin or a 4-pin plug inserted into a jack of the electronic device. A 4-pin plug may provide additional capability over a 3-pin plug, such as by providing not only left and right stereo audio channels, but also a microphone or the ability to transfer data. Whereas existing 3-pin plugs generally have a diameter of about 3.5 millimeters and include three pins soldered within the plug, existing 4-pin plugs generally have a diameter of about 4.6 millimeters and include a fourth pin soldered to the outer dimension of the plug. This design may make the 4-pin plug incompatible with electronic devices designed to accommodate the diameter of 3-pin plugs.

Therefore, it would be beneficial to provide a 4-pin plug with a reduced profile or diameter to enhance the aesthetic appearance of the plug to the user and to enable the plug to be used with a wider range of electronic devices. In addition, it would also be beneficial to secure the fourth pin to the plug using conventional soldering processes.

SUMMARY OF THE DISCLOSURE

Apparatus, systems, and methods for assembling a plug with a low profile for use with an electronic device are provided. In one embodiment, a plug is provided. The plug may include an inner pin extending between a first inner end and a second inner end about a longitudinal axis, wherein the inner pin includes a first inner end contact portion at the first inner end. The plug may include an outer pin extending between a first outer end and a second outer end about the longitudinal axis and about a portion of the inner pin, wherein the outer pin includes a first outer end contact portion at the first outer end. The plug also may include a layer of nonconductive material disposed at least between the outer pin and the portion of the inner pin, wherein the first outer end contact portion extends a first distance beyond the first inner end contact portion in a first direction parallel to the longitudinal axis.

In one embodiment, a plug is provided. The plug may include an inner pin extending between a first inner end and a second inner end about a longitudinal axis, wherein the inner pin includes a first inner end contact portion at the first inner end. The plug may include an outer pin extending between a first outer end and a second outer end about the longitudinal axis and about a portion of the inner pin, wherein the outer pin includes a first outer end contact portion at the first outer end. The plug also may include a layer of nonconductive material disposed at least between the outer pin and the portion of the inner pin, wherein the shortest distance between the first inner end contact portion and the longitudinal axis is at least equal to the shortest distance between the first outer end contact portion and the longitudinal axis. The plug also may include an overmold of nonconductive material disposed about the first outer end contact portion and the first inner end contact portion.

In one embodiment, a plug is provided. The plug may include an inner pin extending between a first inner end and a second inner end about a longitudinal axis, wherein the inner pin includes a first inner end contact portion at the first inner end. The plug may include an outer pin extending between a first outer end and a second outer end about the longitudinal axis and about a portion of the inner pin, wherein the outer pin includes a first outer end contact portion at the first outer end. The plug also may include a layer of nonconductive material disposed at least between the outer pin and the portion of the inner pin, wherein a first plane that is perpendicular to the longitudinal axis intersects the first outer end contact portion and the first inner end contact portion.

In one embodiment, a method for assembling a plug having a longitudinal axis is provided. The method may include inserting an innermost pin at least partially within an inner pin, inserting an outer pin at least partially within the inner pin, wherein the outer pin has a first outer end and a second outer end opposite the first outer end, and wherein the first outer end has a first outer contact portion, disposing nonconductive material between the innermost pin, the inner pin, and the outer pin, and coupling an outermost pin to the plug about the outer pin, wherein the outermost pin has a first outermost end and a second outermost end opposite the first outermost end, the first outermost end has a first outermost contact portion, and the first outermost contact portion extends a first distance beyond the first outer contact portion in a first direction parallel to the longitudinal axis.

In an embodiment, a plug that extends between a cable end and a jack end is provided. The plug may include an inner pin having an inner cable contact at a first inner end and an inner jack contact at a second inner end, and an outer pin having an outer cable contact at a first outer end and an outer jack contact at a second outer end, wherein the distance between the outer cable contact and the cable end is shorter than the distance between the inner cable contact and the cable end.

BRIEF DESCRIPTION OF THE DRAWINGS

The above and other aspects and features of the invention will become more apparent upon consideration of the following detailed description, taken in conjunction with the accompanying drawings, in which like reference characters refer to like parts throughout, and in which.

DETAILED DESCRIPTION OF THE DISCLOSURE

Figure 1:
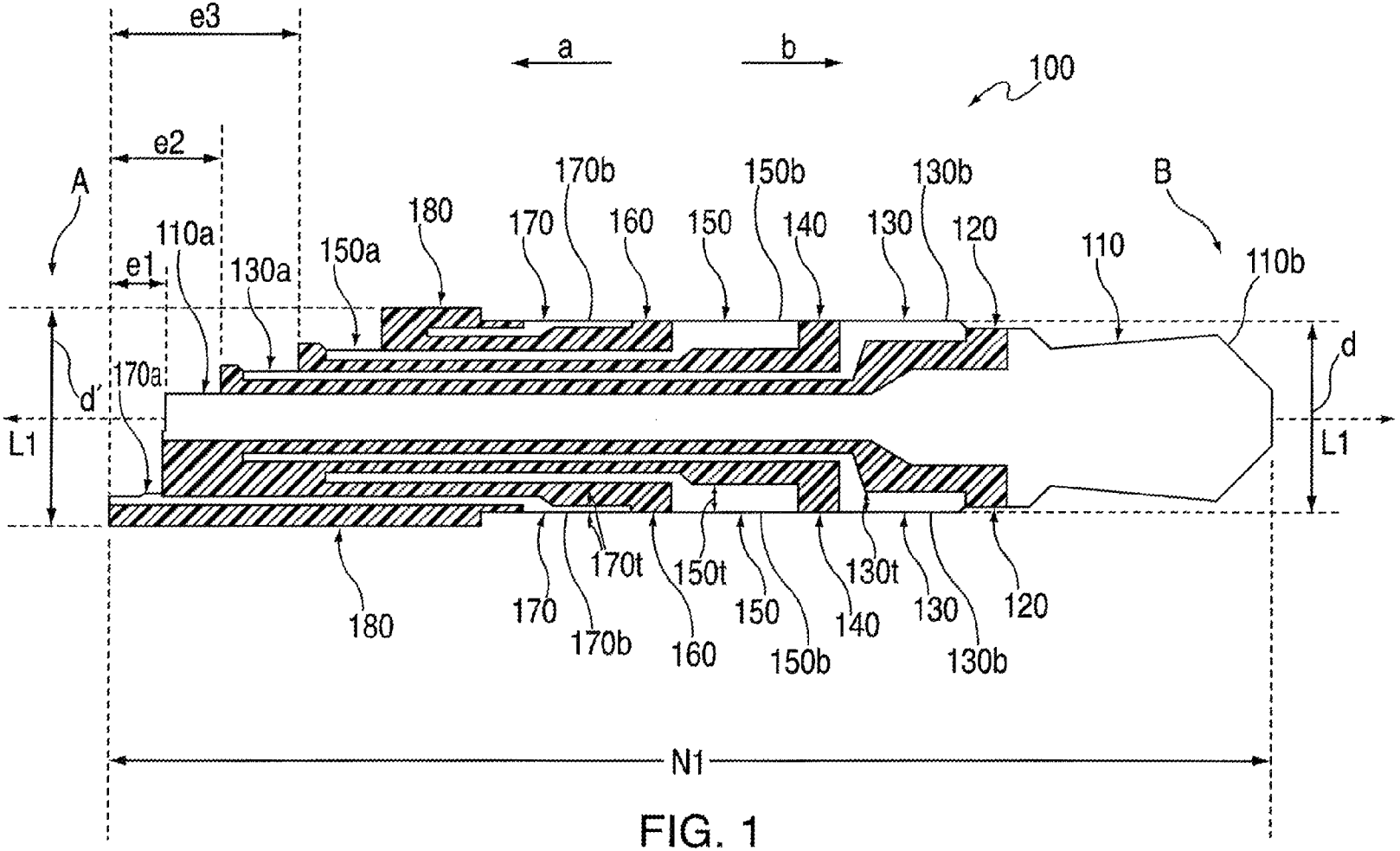
FIG. 1 is a cross-sectional view of an inverted contact plug in accordance with some embodiments of the invention.

In some embodiments, a 4-pin plug may include any suitable features and any suitable dimensions. For example, the plug may include four pins that may be arranged such that each pin is at least partially nested within the next closest pin. The plug also may have any suitable diameter, including, for example, a diameter equal to 3.5 millimeters along its length, which may increase to 4.0 millimeters where an overmold may be disposed around the plug. The fourth pin may be coupled (e.g., soldered) to the plug in any suitable manner and in some embodiments, may be coupled to the plug after the first three pins have been coupled together. In some embodiments, the fourth pin may be soldered to the plug such that a wire of a cable may be soldered to the fourth pin on the internal surface of the plug. The fourth pin also may include a contact point (e.g., a flange) that may extend beyond the contact point of at least one other pin within the plug and that may be inverted away from the contact point of the at least one other pin. In some embodiments, the fourth pin may be shaped such that it includes a contact point at the same distance from one end of the plug as at least one other pin. In some embodiments, the fourth pin may be shaped such that it dives into the plug at the same depth as at least one other pin and obstructs at least a portion of the at least one other pin from emerging underneath the overmold. In such embodiments, the diameter of the plug may not be increased by the inclusion of the fourth pin. Portions of the fourth pin may be thinner than one or more of the other pins, such as at the point where the pins are exposed (e.g., the face of the pin) to a user of the plug. However, the face of the fourth pin may have the same outward appearance as the other pins in the plug.

The plug also may include any suitable number of nonconductive or isolating regions to separate the conductive pins. In some embodiments, the nonconductive regions may be made from polypropylene. The plug also may include any suitable nonconductive overmold that may be disposed around one end of the plug to protect the coupling of the pins to any suitable device (e.g., a cable of an accessory device). In some embodiments, any other suitable member, such as a strain relief member or a hard plastic member may also be molded over the plug.

One contact end or flange of each pin that may emerge underneath the overmold may be coupled (e.g., soldered) to any other suitable device to form an electrical connection. For example, the plug may be coupled to a cable that in turn may be coupled to a pair of headphones. The plug may be inserted into a jack of an electronic device and may be configured to receive audio information from the electronic device via the jack and may be configured to transmit the audio information to the user via the cable and the headphones. Alternatively, the plug may be used with an electronic device to transfer data and power, similar to a Universal Serial Bus ("USB") connector.

Apparatus, systems, and methods for assembling a plug with a low profile for use with an electronic device are provided and described with reference to FIGS. 1-5.

Figure 2:
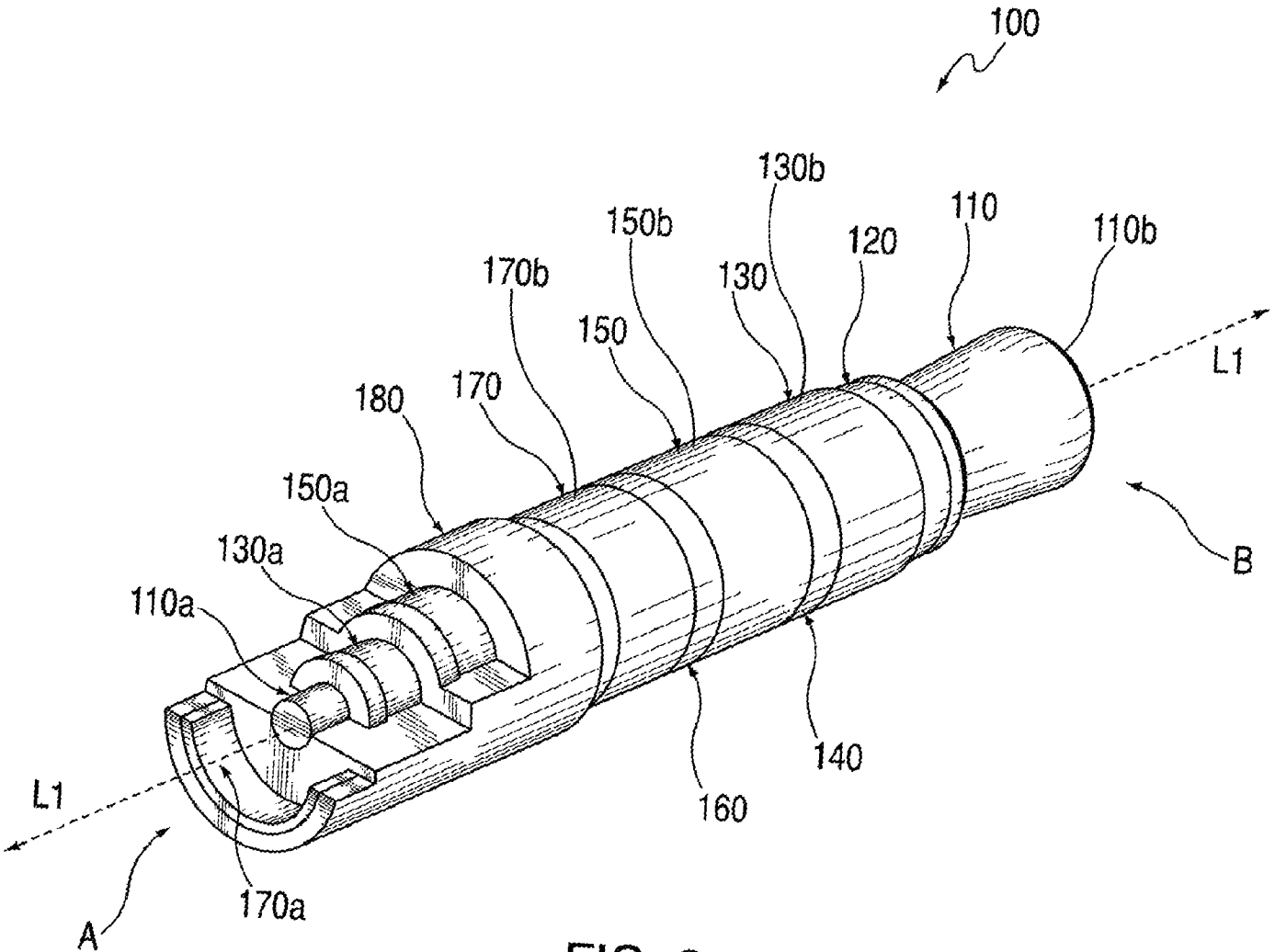
FIG. 2 is a perspective view of the inverted contact plug of FIG. 1 in accordance with some embodiments of the invention.

FIG. 1 is a cross-sectional view of an inverted contact plug in accordance with some embodiments of the invention. Plug 100 may include any suitable number of conductive contacts or pins. For example, plug 100 may include four pins 110, 130, 150, and 170, each of which may include any suitable conductive material (e.g., metal) and may be of any suitable length N1 from end A to end B of plug 100. Pin 110 may be solid or hollow (not shown), whereas pins 130, 150, and 170 may be hollow (e.g., hollow cylinders). In some embodiments, pins 110, 130, 150, and 170 may extend along and about longitudinal axis L1 and may be nested within one another. For example, as shown in FIGS. 1 and 2, pin 110 (e.g., an innermost pin) may extend along and about axis L1 at least partially within the hollow of pin 130, pin 130 (e.g., a mid-inner pin or an inner pin) may extend along and about axis L1 at least partially within the hollow of pin 150, and pin 150 (e.g., an inner pin or an outer pin) may extend along and about axis L1 at least partially within the hollow of pin 170 (e.g., an outer pin or an outermost pin). At one end A of plug 100, a conductive portion of each one of pins 110, 130, 150, and 170, respectively, may be exposed, such as, for example, end 110*a*, and flanges 130*a*, 150*a*, and 170*a*, which may be coupled to respective portions of any other suitable device to form an electrical connection. Towards end B, each one of pins 110, 130, 150, and 170 may present face 110*b*, 130*b*, 150*b*, and 170*b*, respectively, to a user of plug 100 that may be inserted in the direction of arrow b within a jack of an electronic device.

In some embodiments, at least a portion of pin 170 may have an inner facing solder pad such that a wire of a cable (e.g., a cable coupled to headphones) may be soldered to pin 170 on the internal surface of plug 100, rather than being soldered to an outside surface of plug 100. Before pin 170 may be soldered to plug 100, however, any suitable portion of pin 170 may be removed, including, for example, 75% of the area containing the soldering component of the pin (e.g., 75% of the weight) that creates pin 170. In another embodiment, pin 170 may be formed such that the material does not have to be removed later (e.g., pin 170 may be formed as an asymmetrical cylinder that includes flange 170*a*). Such a pin 170 may permit plug 100 to include four pins soldered to the inside of plug 100 within a diameter d (e.g., a diameter of 3.5 millimeters), and also may permit both flanges 150*a* and 170*a* to be exposed at end A so as to be coupled to any other suitable device without obstructing one another. For example, flange 170*a* may extend or be provided beyond end 110*a* and beyond flanges 130*a* and 150*a* towards end A without obstructing any of end 110*a*, flange 130*a*, or flange 150*a* from being coupled to any suitable device. Although pin 170 may include a solder contact on the inside of plug 100 and pin 150 may be at least partially inserted within the hollow of pin 170, the maximum solder height of plug 100 (which may be equal to diameter d) may be determined by pin 150 because face 170*b* may have a thickness 170*t* that may be thinner than the thickness 150*t* of face 150*b* where pins 150 and 170 may be exposed to a user of plug 100. In some embodiments, thickness 170*t* also may be thinner than thickness 130*t* of face 130*b*.

In some embodiments, plug 100 may be coupled to any suitable device, such as a cable extending from headphones, to form an electrical connection in any suitable manner. End 110*a* of pin 110 may be soldered to a wire within a cable that may in turn be coupled to headphones. Pins 130 and 150 may be soldered at flanges 130*a* and 150*a* to two additional wires within the cable. Pin 170 may be soldered to a fourth wire within the cable at flange 170*a*. Flange 170*a* may extend beyond end 110*a* and flanges 130*a* and 150*a* towards end A (e.g., along axis L1 away from flange 170*b* at end B of plug 100). For example, flange 170*a* may extend a distance e1 beyond end 110*a*, in the direction of arrow a along longitudinal axis L1 toward end A of plug 100. Flange 170*a* also may extend a distance e2 beyond flange 130*a*, in the direction of arrow a along longitudinal axis L1 toward end A of plug 100.

Flange 170*a* also may extend a distance e3 beyond flange 150*a*, in the direction of arrow a along longitudinal axis L1 toward end A of plug 100.

Plug 100 may include any suitable number of nonconductive or isolating regions to separate conductive pins 110, 130, 150, and 170. Regions 120, 140, and 160 may include any suitable nonconductive material, including, for example, polypropylene or another plastic. Regions 120, 140, and 160 may be formed in any suitable manner, including, for example, by being poured around a nested arrangement of pins 110, 130, and 150 and, in some embodiments, around pin 170 during the assembly of plug 100. Plug 100 also may include any suitable nonconductive region 180 that may be disposed around portions of end 110*a* and flanges 130*a*, 150*a*, and 170*a* to protect the coupling of the pins to any suitable device at end A. Region 180 may include the same material as regions 120, 140, and 160 and, when disposed around plug 100, may increase the diameter of plug 100 from diameter d to diameter d'. The assembly of plug 100 is described further below with respect to FIG. 5. Plug 100 may include any suitable dimensions. In some embodiments, plug 100 may include any suitable diameter d, including, for example, a diameter d equal to 3.5 millimeters. In some embodiments, plug 100 may also include any suitable second diameter d', including, for example, a diameter d' equal to 4.0 millimeters. In some embodiments, plug 100 may include any suitable length N1, including, for example, a length of 20 millimeters. In some embodiments, each of pins 110, 130, 150, and 170 may be centered about longitudinal axis L1.

When end B of plug 100 is inserted into any suitable jack (e.g., any suitable 3-pole or 4-pole audio jack of an electronic device), each of pins 110, 130, 150, and 170 may contact a conductive region or pole of the jack to create an electrical connection. The jack (not shown) may include any suitable design to accept plug 100. In some embodiments, the electronic device may include a trimless port into which plug 100 may be inserted, as described more fully in Lynch et al., U.S. patent application Ser. No. 12/188,735, filed on Aug. 8, 2008 (now U.S. Pat. No. 7,771,240, issued on Aug. 10, 2010), which is incorporated by reference herein in its entirety.

The electrical connection between plug 100 and the jack may be used to transmit audio signals or other data between the electronic device and any device that may be coupled to plug 100 (e.g., headphones). In some embodiments, pin 110 may be used to provide audio to a left headphone driver, pin 130 may be used to provide audio to a right headphone driver, pin 150 may serve to ground plug 100 with respect to the jack, and pin 170 may provide a microphone capability to a user of the headphones. Pin 170 also may be used in conjunction with controlling the volume of the audio emitted from the headphones. For example, the volume may be controlled through a device that may be coupled to a headphones cable, the cable may be coupled to plug 100, and a wire in the cable that may be associated with controlling the device may be coupled to pin 170. In some embodiments, plug 100 may be used as a USB connector. For example, pins 110 and 130 may be used to transfer data between any suitable electronic device (e.g., an iPod Shuffle™ available by Apple Inc. of Cupertino, Calif.) and any suitable device coupled to plug 100 (e.g., a computer). In such embodiments, pin 150 may be used to ground plug 100 to the electronic device, and pin 170 may be used to provide power to the device coupled to plug 100.

FIG. 2 is a perspective view of plug 100 in accordance with some embodiments of the invention. At least faces 130*b*, 150*b*, and 170*b* may be uniform around the circumference and along the length of plug 100 and they may be separated by nonconductive regions 120, 140, and 160. Region 180 is shown in FIGS. 1 and 2 as being cut away from end 110*a* and flanges 130*a*, 150*a*, and 170*a* at end A to show the contact portions of plug 100 at end A, but it is to be understood that region 180 may include a uniform cylinder that may be disposed, or molded, over end 110*a* and flanges 130*a*, 150*a*, and 170*a* to protect any physical and/or electrical connections with any suitable device. In some embodiments, any other suitable member, such as a strain relief member or a hard plastic member may also be molded over plug 100 and/or region 180, as more fully described in Stiehl et al., U.S. patent application Ser. No. 12/218,450, filed on Jul. 14, 2008 (now U.S. Pat. No. 7,833,055, issued Nov. 16, 2010), which is incorporated by reference herein in its entirety.

The location of flange 170*a* may extend beyond end 110*a* and flanges 130*a* and 150*a* toward end A of plug 100. To accommodate pin 170 within the same diameter d that may be needed to accommodate pins 110, 130, and 150, at least a portion of pin 170 at end A may be removed (e.g., a portion of pin 170 adjacent flange 170*a* about longitudinal axis L1) or pin 170 may be formed as an asymmetrical cylinder, thereby permitting flanges 130*a* and 150*a* to also be exposed at end A. Although face 170*b* may include thickness 170*t* (FIG. 1) that may be thinner than thickness 150*t* (FIG. 1) of face 150*b* and thickness 130*t* (FIG. 1) of face 130*b*, pin 170 may have the same outward appearance as pins 130 and 150 to a user of plug 100 (e.g., at end B).

Figure 3:
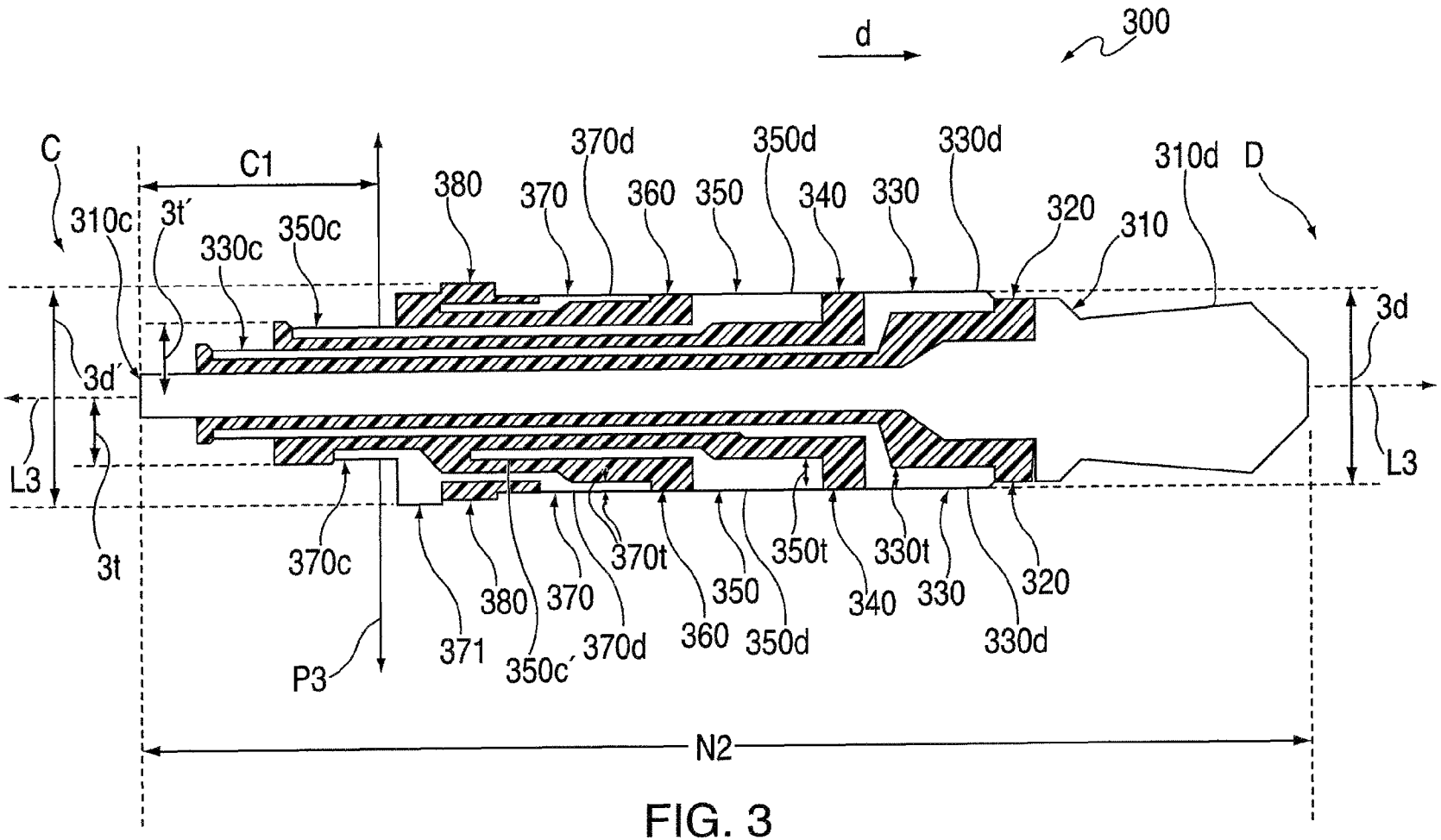
FIG. 3 is a cross-sectional view of a diving contact plug in accordance with some embodiments of the invention.
Figure 4:
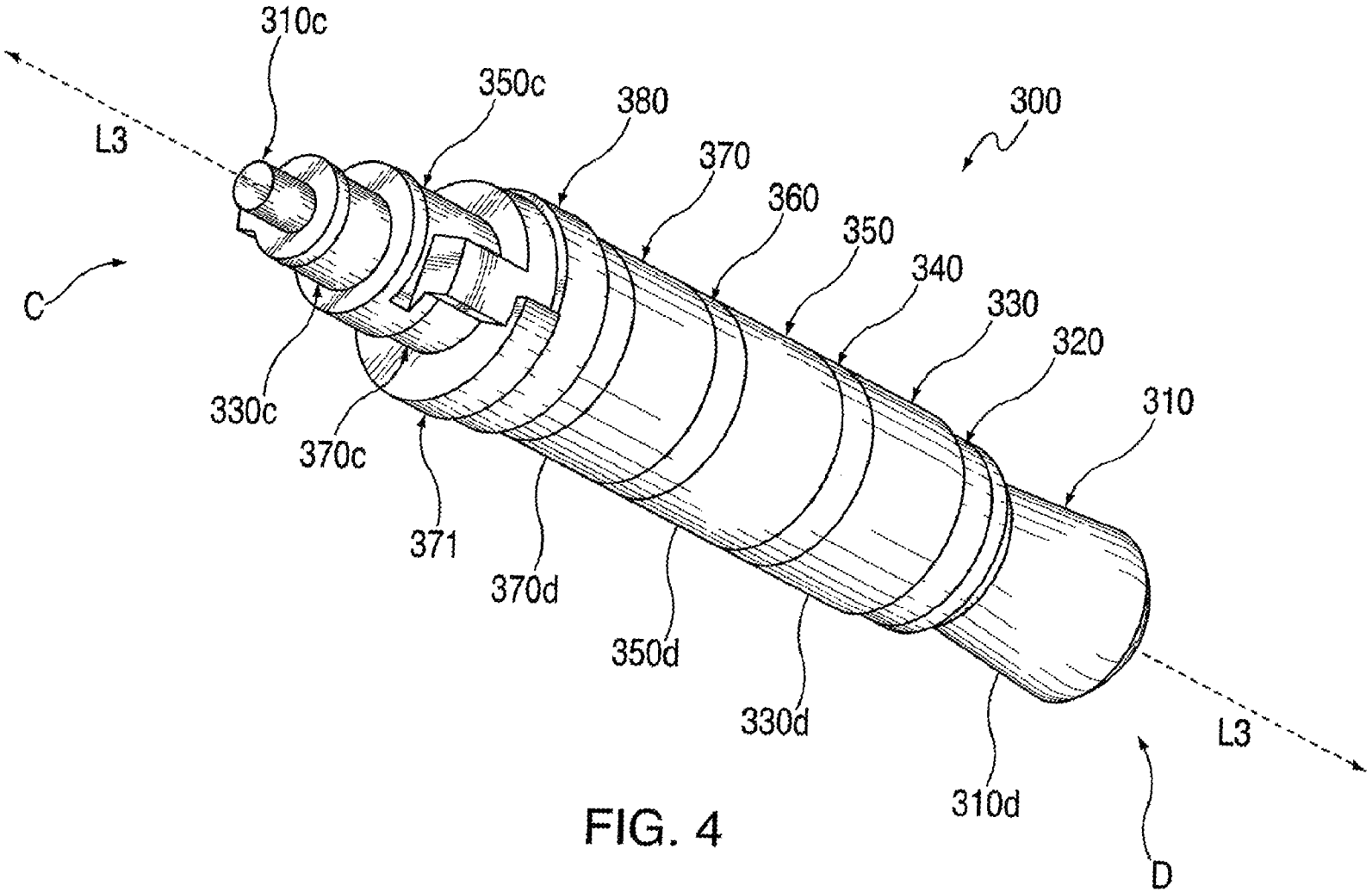
FIG. 4 is a perspective view of the diving contact plug of FIG. 3 in accordance with some embodiments of the invention.

In some embodiments, a plug may be assembled with two or more pins arranged in any suitable alternative fashion. FIG. 3 is a cross-sectional view of a diving contact plug in accordance with some embodiments of the invention. Plug 300 may include any suitable number of conductive contacts or pins. For example, plug 300 may include four pins 310, 330, 350, and 370, each of which may include any suitable conductive material (e.g., metal) and may be of any suitable length from end C to end D of plug 300. Pin 310 may be solid or hollow (not shown), whereas pins 330, 350, and 370 may be hollow. In some embodiments, pins 310, 330, 350, and 370 may extend along and about longitudinal axis L3 and may be nested within one another. For example, as shown in FIGS. 3 and 4, pin 310 (e.g., an innermost pin) may extend along and about axis L3 at least partially within the hollow of pin 330, pin 330 (e.g., a mid-inner pin or an inner pin) may extend along and about axis L3 at least partially within the hollow of pin 350, and pin 350 (e.g., an inner pin or an outer pin) may extend along and about axis L3 at least partially within the hollow of pin 370 (e.g., an outer pin or an outermost pin). At one end C of plug 300, a conductive portion of each one of pins 310, 330, 350, and 370, respectively, may be exposed, such as, for example, end 310*c*, and flanges 330*c*, 350*c*, and 370*c*, which may be coupled to respective portions of any other suitable device to form an electrical connection.

Each one of pins 310, 330, 350, and 370 may also present face 310*d*, 330*d*, 350*d*, and 370*d*, respectively, to a user of plug 300 that may be inserted in the direction of arrow d within a jack of an electronic device. Face 370*d* may have a thickness 370*t* that may be thinner than the thickness 350*t* of face 350*d* where pins 350 and 370 may be exposed to a user of plug 300. In some embodiments, thickness 370*t* also may be thinner than thickness 330*t* of face 330*d*.

In some embodiments, pin 370 may be coupled to other portions of plug 300 such that at least a portion of pin 370 (e.g., flange 370*c* that may be exposed at end C for being coupled to any suitable device) may be at the same depth 3*t* from longitudinal axis L3 within plug 300 as a portion of pin 350 (e.g., portion 350*c*'). In other embodiments, portions of pin 370 may be even closer to axis L3 than portions of pin 350 (e.g., flange 370*c* may be at a depth 3*t* from axis L3 that is less than or equal to a depth 3*t*' between flange 350*c* and axis L3). In some embodiments, pin 370 may be soldered to other portions of plug 300 such that flange 370*c* and flange 350*c* may be at least partially exposed at the same distance C1 from end C (e.g., from end 310*c* of pin 310) for being coupled to any suitable device. That is, in some embodiments, a plane perpendicular to axis L3 at a distance C1 from end C may intersect both flange 350*c* and flange 370*c* (e.g., a plane that includes the line P3 and that is perpendicular to axis L3). In some embodiments, a plane that includes the line P3 at a distance C1 from end C and that is perpendicular to axis L3 may intersect ends 310*c* and 330*c* and flanges 350*c* and 370*c*.

Before a portion of pin 370 may be soldered at the same depth 3*t* as pin 350, for example, any suitable portion of the conductive material that creates pin 350 may be removed. In other embodiments, pin 350 may be formed such that the material does not have to be removed later (e.g., pin 350 may be formed as an asymmetrical cylinder that includes flange 350*c*). Such embodiments of pin 350 may permit plug 300 to include four pins soldered within a diameter 3*d* (e.g., a diameter of 3.5 millimeters), and also may permit both flanges 350*c* and 370*c* to be coupled to any other suitable device. Because at least a portion of pin 350 may be shaped to permit pin 370 to be soldered at the same depth 3*t* from longitudinal axis L3 as pin 350, the portion of pin 370 that may be exposed at end C (e.g., flange 370*c*) may be spaced about axis L3 from the exposed portion of pin 350 (e.g., flange 350*c*) so as not to obstruct that portion of pin 350. In some embodiments, flange 370*c* and flange 350*c* may be exposed at the same distance C1 along axis L3 of plug 300 from end C.

In some embodiments, plug 300 may be coupled to any suitable device, such as a headphone cable, to form an electrical connection in any suitable manner. Ends 310*c* and 330*c* may be soldered to two different wires within a cable that may in turn be coupled to drivers of the headphones. Pins 350 and 370 may be soldered at flanges 350*c* and 370*c*, respectively, to two further wires within the cable (e.g., ground and a microphone). In some embodiments, pins 310 and 330 may be used to transfer data between any suitable electronic device and any suitable device coupled to plug 300. In such embodiments, pin 350 may be used to ground plug 300 to the electronic device, and pin 370 may be used to provide power to the device coupled to plug 300, such that plug 300 may be used as a USB cable connector, for example.

Plug 300 also may include any suitable number of nonconductive or isolating regions to separate conductive pins 310, 330, 350, and 370. Regions 320, 340, 360, and 380 may be the same as, and may include some or all of the features of, regions 120, 140, 160, and 180 (FIGS. 1 and 2), respectively. Regions 320, 340, 360, and 380 also may be formed in any suitable manner, including, for example, in the same manner as regions 120, 140, 160, and 180. When disposed around plug 300, region 380 may increase the diameter of plug 300 from diameter 3*d* to diameter 3*d*'. The assembly of plug 300 is also described further below with respect to FIG. 5.

Plug 300 may include any suitable dimensions. In some embodiments, plug 300 may include any suitable diameter 3*d*, including, for example, a diameter 3*d* equal to diameter d (e.g., 3.5 millimeters). In some embodiments, plug 300 may include any suitable second diameter 3*d*', including, for example, a diameter 3*d*' equal to diameter d' (e.g., 4.0 millimeters). In some embodiments, each of pins 310, 330, 350, and 370 may be centered about longitudinal axis L3.

In some embodiments, plug 300 also may include any suitable length N2, including, for example, a length of 19 meters. Length N2 may be the same as, or shorter than, length N1 of plug 100. For example, length N2 may be shorter than length N1 if flange 370*c* is at the same depth 3*t* (or in some embodiments, a greater depth) from axis L3 as portion 350*c*' because both flange 370*c* and flange 350*c* may be exposed for coupling to any suitable electronic device without having to extend flange 370*c*, and plug 300, beyond flange 350*c*.

Alternatively, length N2 may be shorter than length N1 if flange 370*c* and flange 350*c* are at least partially exposed at the same distance C1 from end C (e.g., at end 310*c* of pin 310) because both flange 370*c* and flange 350*c* may be exposed for coupling to any suitable electronic device without having to extend flange 370*c*, and plug 300, beyond flange 350*c*. Length N2 may be shortened further if at least a portion of the other pins of plug 300 are located at the same depth with respect to axis L3 (not shown). For example, length N2 may be shortened further if flange 370*c* is at the same or greater depth from longitudinal axis L3 as portion 350*c*' and if at least a portion of pin 330 is at the same depth (or, in some embodiments, a greater depth) from axis L3 as at least a portion of pin 310. Any combination of shared depths between at least two pins of plug 300 may be used to shorten length N2. In some embodiments, length N2 also may be shortened further if ends 310*c* and 330*c*, and flanges 350*c* and 370*c* are all at least partially exposed at the same distance C1 from end C (not shown). Any combination of exposure distances between at least two pins of plug 300 may be used to shorten length N2.

When inserted into any suitable jack (e.g., any suitable 3-pole or 4-pole audio jack of an electronic device), plug 300 may interact with the jack in the same manner as plug 100. For example, plug 300 may be used to transmit audio signals or other data between the electronic device and any device that may be coupled to plug 300 (e.g., headphones).

FIG. 4 is a perspective view of plug 300 in accordance with some embodiments of the invention. At least faces 330*d*, 350*d*, and 370*d* may be uniform around the circumference and/or along the length of plug 300 at end D, and they may be separated by nonconductive regions 320, 340, and 360. Portions of region 380 are shown in FIGS. 3 and 4 as being cut away from ends 310*c* and 330*c* and notched between flange 350*c* and portion 371 at end C, but it is to be understood that region 380 may include a uniform cylinder molded over ends 310*c* and 330*c*, flanges 350*c* and 370*c*, and portion 371 to protect any physical and electrical connection between plug 300 and any suitable device. In some embodiments, any other suitable member, such as a strain relief member or a hard plastic member, may also be molded over plug 300 and/or region 380.

The location of flange 370*c* may be at the same depth 3*t* from longitudinal axis L3 as flange 350*c* and/or may be exposed at the same distance C1 along axis L3 of plug 300 from end C (e.g., from end 310*c* of pin 310). To accommodate pin 370 within the same diameter 3*d* that may be needed to accommodate pins 310, 330, and 350, at least a portion of pin 350 towards end C may be removed (e.g., a portion of pin 350 adjacent flange 350*c* about longitudinal axis L3) or pin 350 may be formed as an asymmetrical cylinder, thereby permitting both of flanges 350*c* and 370*c* to be exposed at end C. Although face 370*d* may include a thickness 370*t* (FIG. 3) that may be thinner than thickness 330*t* (FIG. 3) of face 330*d* and thickness 350*t* (FIG. 3) of face 350*d*, pins 330, 350, and 370 all may have the same outward appearance to a user of plug 300.

While 4-pin plugs have been shown in each of FIGS. 1-4, it is to be understood that a plug that includes any suitable number of pins may be configured according to the invention. For example, plug 100 and/or plug 300 may include two pins or three pins, where at least one of the pins may be partially asymmetrical and may be soldered within the plug, or may be soldered to dive down to the depth of at least one of the other pins, or may be exposed at a certain distance along the plug as another pin. For example, a 3-pin plug may include a third pin that may dive down to the depth of at least a second pin and the second pin may dive down to the depth of a first pin. Alternatively, the third pin may be exposed at a particular distance along the plug as the second pin and/or the second pin may be exposed at the same distance along the plug as the first pin. Any suitable combination of shared depths and/or exposure distances may be used with at least two pins.

Figure 5:
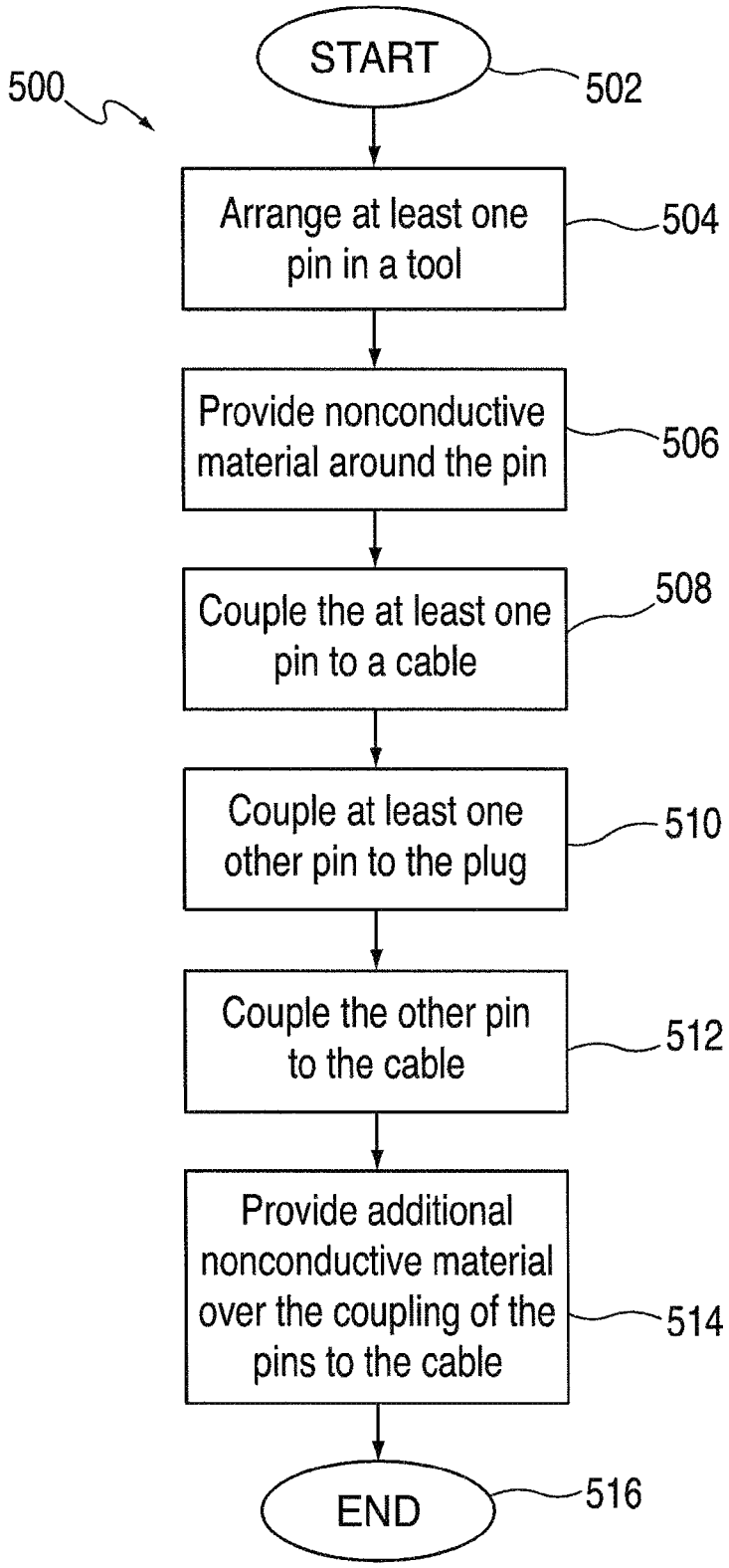
FIG. 5 is a flowchart of an illustrative process for assembling a plug and coupling the plug to a cable in accordance with some embodiments of the invention.

FIG. 5 is a flowchart of an illustrative process for assembling a plug and coupling the plug to a cable in accordance with some embodiments of the invention. In some embodiments, plug 100 and plug 300 may be assembled in the same manner. Process 500 may begin at step 502. At step 504, at least one conductive contact or pin may be arranged within a tool. For example, pin 150 or pin 350 may be inserted at least partially into a tool. In some embodiments, any suitable number of pins, including, for example, pins 110, 130, and 150 and/or pin 170, may be inserted into the tool in any suitable arrangement (e.g., a nested arrangement). The pin or pins may include any suitable material, such as metal, and may be of any suitable dimensions. In some embodiments, at least a portion of the conductive material that creates pin 350 may be removed before pin 350 may be arranged within the tool. In some embodiments, pin 350 may be pre-formed as an asymmetrical cylinder (e.g., a cylinder with a portion of conductive material already missing about one end portion). In some embodiments, the pin arranged within the tool at step 504 may include any suitable cross-section, such as a square, rectangular, or elliptical cross-section, or any other suitable cross-section.

At step 506, a layer of nonconductive material may be provided around the at least one pin placed in the tool. For example, the nonconductive material may include polypropylene that may be poured into the tool around at least a portion of the pin, but at least a portion of one or both ends of the pin may remain exposed beyond the nonconductive material. In some embodiments, the nonconductive material may be formed so as to extend beyond both ends of the pin and thereafter at least a portion of the nonconductive material may be removed from one or both ends of the pin. The one or more exposed ends may be used to couple the plug to a cable or to a jack of an electronic device. In some embodiments, the nonconductive material may be poured around and between any suitable number of pins (e.g., pins 310, 330, and 350) to stabilize the pins within the plug and to electrically isolate the pins from one another. Each pin may be at least partially exposed, however, at one or both ends beyond the nonconductive material.

At step 508, a portion of the pin may be coupled to a cable in any suitable fashion. For example, flange 150*a* or flange 350*c* may be coupled (e.g., soldered) to a wire within the cable. The cable, in turn, may be coupled to any suitable device, including, for example, headphones. Soldering the pin to the wire may create an electrical connection between the plug and the device that may be used to transmit audio or other data between the device and a user of the device.

Process 500 may advance to step 510, where at least one other pin may be coupled to the plug. For example, pin 170 may be coupled to plug 100 such that at least a portion of pin 170 (e.g., flange 170*a*) may be exposed on the internal surface of plug 100 and also may be exposed beyond the nonconductive material provided at step 506. In some embodiments, at least a portion of the conductive material that creates pin 170 may be removed before pin 170 may be coupled to plug 100, or pin 170 may be pre-formed as an asymmetrical cylinder (e.g., a cylinder with a portion of conductive material already missing about one end portion), to permit flange 170*a* to extend toward end A of plug 100 without also obstructing end 110*a* and flanges 130*a* and 150*a* from extending toward end A and from being coupled to any suitable device. As with the pin arranged in the tool at step 504, the other pin also may include any suitable cross-section, such as a square, rectangular, or elliptical cross-section, or any other suitable cross-section. Alternatively, pin 370 may be soldered to the nonconductive material and flange 370*c* and portion 371 may be exposed beyond a portion of pin 350 and beyond the nonconductive material provided at step 506.

In some embodiments, step 510 may be performed prior to performing step 508. For example, all of the pins may be coupled to form the plug before at least one of the pins may be coupled to a cable (e.g., a headphones cable). In some embodiments, step 510 also may be performed prior to performing step 506. For example, all of the pins of the plug may be arranged within the tool before the nonconductive material is provided around the pins. Alternatively, the at least one other pin may be coupled to the plug at step 510 as described and another layer of nonconductive material may be disposed around at least a portion of the other pin before any of the pins of the plug may be coupled to a cable.

At step 512, the other pin may be coupled to the cable. For example, flange 170*a* or flange 370*c* may be soldered to a wire within the cable. Process 500 may advance to step 514, where another layer of nonconductive material may be provided around the coupling of the pins to the cable. For example, an additional layer of polypropylene (e.g., region 180) may be poured around the location at end A where pins 150 and 170 may be coupled to the wires (e.g., at flanges 150*a* and 170*a*) to protect the electrical connection between the plug and the cable. In some embodiments, the additional layer of nonconductive material may be provided around the plug before any of the pins of the plug may be coupled to the cable. Alternatively, in some embodiments, the nonconductive material provided at step 506 may be provided at the same time that an additional layer of nonconductive material may be provided around the at least one other pin of step 510 or at the same time that the additional layer of nonconductive material at step 514 may be provided. Process 500 may then advance to step 516 and end.

It will be understood that process 500 may be modified in any suitable way and that the steps may be performed in any suitable order. For example, in some embodiments, all of the pins of the plug may be arranged in the tool and a layer of nonconductive material may be disposed about at least a portion of all of the pins before the pins may be coupled to any suitable device. Alternatively, in some embodiments, some of the pins of the plug (e.g., 3 pins) may be arranged in the tool and a layer of nonconductive material may be disposed about at least a portion of each of those pins. Another pin (e.g., a fourth pin) may be coupled to the plug, an additional layer of nonconductive material may be disposed about at least a portion of the other pin, and then all of the pins may be coupled to any suitable device.

While there have been described apparatus, systems and methods for assembling a plug with a low profile, it is to be understood that many changes may be made therein without departing from the spirit and scope of the invention. It will also be understood that various directional and orientational terms such as "up" and "down," "left" and "right," "top" and "bottom," "side" and "edge" and "corner," "height" and "width" and "depth," "horizontal" and "vertical," and the like are used herein only for convenience, and that no fixed or absolute directional or orientational limitations are intended by the use of these words. For example, each of the pins can have any desired orientation within the plug. If reoriented, different directional or orientational terms may need to be used in their description, but that will not alter their fundamental nature as within the scope of the invention. Those skilled in the art will appreciate that the invention can be practiced by other than the described embodiments, which are presented for purposes of illustration rather than of limitation, and the invention is limited only by the claims which follow.

What is claimed is:

1. A plug comprising:

an innermost pin extending between a first innermost end and a second innermost end about a longitudinal axis;

a mid-inner pin extending between a first mid-inner end and a second mid-inner end about the longitudinal axis and about a portion of the innermost pin;

an inner pin extending between a first inner end and a second inner end about the longitudinal axis and about a portion of the mid-inner pin; and an outer pin extending between a first outer end and a second outer end about the longitudinal axis and about a portion of the inner pin, wherein:

the first outer end of the outer pin extends a first distance beyond the first inner end of the inner pin in a first direction parallel to the longitudinal axis;

the first outer end of the outer pin extends a second distance beyond the first mid-inner end of the mid-inner pin in the first direction parallel to the longitudinal axis;

the first outer end of the outer pin extends a third distance beyond the first innermost end of the innermost pin in the first direction parallel to the longitudinal axis; and the shortest distance between the first outer end of the outer pin and the longitudinal axis is one of equal to and less than the shortest distance between the first inner end of the inner pin and the longitudinal axis.

2. The plug of claim 1, wherein the first distance is greater than the second distance.

3. The plug of claim 2, wherein the second distance is greater than the third distance.

4. The plug of claim 1, wherein:

the innermost pin comprises a first innermost end contact portion at the first innermost end;

the mid-inner pin comprises a first mid-inner end contact portion at the first mid-inner end;

the inner pin comprises a first inner end contact portion at the first inner end;

the outer pin comprises a first outer end contact portion at the first outer end;

the first outer end contact portion of the outer pin extends the first distance beyond the first inner end contact portion of the inner pin in the first direction parallel to the longitudinal axis;

the first outer end contact portion of the outer pin extends the second distance beyond the first mid-inner end contact portion of the mid-inner pin in the first direction parallel to the longitudinal axis; and the first outer end contact portion of the outer pin extends the third distance beyond the first innermost end contact portion of the innermost pin in the first direction parallel to the longitudinal axis.

5. The plug of claim 1, wherein:

the inner pin comprises a first inner end contact portion at the first inner end;

the first inner end contact portion faces away from the longitudinal axis;

the outer pin comprises a first outer end contact portion at the first outer end; and the first outer end contact portion faces towards the longitudinal axis.

6. The plug of claim 1, wherein:

the inner pin comprises a first inner end contact portion at the first inner end;

the outer pin comprises a first outer end contact portion at the first outer end; and the plug further comprises an overmold of nonconductive material disposed about the first outer end contact portion and the first inner end contact portion.

7. The plug of claim 1, wherein:

the inner pin comprises a first inner end contact portion at the first inner end;

the outer pin comprises a first outer end contact portion at the first outer end; and the shortest distance between the first outer end contact portion and the longitudinal axis is equal to the shortest distance between the first inner end contact portion and the longitudinal axis.

8. The plug of claim 1, wherein:

the inner pin comprises a first inner end contact portion at the first inner end;

the outer pin comprises a first outer end contact portion at the first outer end; and the shortest distance between the first outer end contact portion and the longitudinal axis is less than the shortest distance between the first inner end contact portion and the longitudinal axis.

9. The plug of claim 1, further comprising a layer of nonconductive material disposed at least between the outer pin and the portion of the inner pin.

10. The plug of claim 9, wherein a portion of the outer pin is disposed within the layer.

11. The plug of claim 1, wherein the maximum diameter of the plug is 3.5 millimeters.

12. The plug of claim 1, further comprising an overmold of nonconductive material disposed about the first outer end, the first inner end, the first mid-inner end, and the first innermost end.

13. The plug of claim 12, wherein the maximum diameter of the overmold is 4.0 millimeters.

14. The plug of claim 13, wherein the maximum diameter of the plug is 3.5 millimeters.

15. The plug of claim 1, wherein:

the inner pin comprises a first inner end contact portion at the first inner end;

the outer pin comprises a first outer end contact portion at the first outer end; and each of the first outer end contact portion and the first inner end contact portion is configured to couple to a respective wire of a cable.

16. The plug of claim 1, wherein:

the outer pin comprises a first outer end contact portion at the first outer end; and the first outer end contact portion is on the inside of the plug.

17. The plug of claim 1, wherein the longitudinal axis does not intersect any portion of the outer pin.

18. The plug of claim 1, wherein:

the outer pin comprises a first outer end contact portion at the first outer end;

the inner pin comprises a first inner end contact portion at the first inner end; and both the first inner end contact portion and the first outer end contact portion face a first side of the plug.

19. The plug of claim 18, wherein:

the first inner end contact portion is between the longitudinal axis and the first side of the plug; and the longitudinal axis is between the first outer end contact portion and the first side of the plug.

20. The plug of claim 19, wherein:

the mid-inner pin comprises a first mid-inner end contact portion at the first mid-inner end;

the first mid-inner end contact portion faces the first side of the plug; and the first mid-inner end contact portion is between the longitudinal axis and the first side of the plug.

21. The plug of claim 1, wherein the mid-inner pin comprises a first mid-inner end contact portion at the first mid-inner end; and the first mid-inner end contact portion faces away from the longitudinal axis.

22. The plug of claim 1, wherein the longitudinal axis does not intersect any portion of the inner pin.

23. The plug of claim 1, wherein the longitudinal axis does not intersect any portion of the mid-inner pin.

24. A plug comprising:

a mid-inner pin extending between a first mid-inner end and a second mid-inner end about a longitudinal axis, the mid-inner pin comprising a first mid-inner end contact portion at the first mid-inner end;

an inner pin extending between a first inner end and a second inner end about the longitudinal axis and about a portion of the mid-inner pin, the inner pin comprising a first inner end contact portion at the first inner end; and an outer pin extending between a first outer end and a second outer end about the longitudinal axis and about a portion of the inner pin, the outer pin comprising a first outer end contact portion at the first outer end, wherein:

each of the first outer end contact portion and the first inner end contact portion is configured to be coupled to a respective wire of a cable;

each of the second outer end and the second inner end is configured to be inserted into a jack;

the shortest distance between the first inner end contact portion and the longitudinal axis is one of equal to and greater than the shortest distance between the first outer end contact portion and the longitudinal axis; and the shortest distance between the first mid-inner end contact portion and the longitudinal axis is one of equal to and greater than the shortest distance between the first inner end contact portion and the longitudinal axis.

25. The plug of claim 24, wherein the first outer end contact portion dives towards the longitudinal axis at the first outer end.

26. The plug of claim 24, further comprising a layer of nonconductive material disposed at least between the outer pin and the portion of the inner pin.

27. The plug of claim 24, wherein a portion of the outer pin is disposed within the layer.

28. The plug of claim 24, further comprising an overmold of nonconductive material disposed about the first outer end contact portion and the first inner end contact portion.

29. The plug of claim 24, further comprising an innermost pin extending between a first innermost end and a second innermost end about the longitudinal axis, wherein:

the mid-inner pin extends about a portion of the innermost pin;

the innermost pin includes a first innermost end contact portion at the first innermost end; and the shortest distance between the first innermost end contact portion and the longitudinal axis is one of equal to and greater than the shortest distance between the first mid-inner end contact portion and the longitudinal axis.

30. The plug of claim 24, further comprising an innermost pin extending between a first innermost end and a second innermost end about the longitudinal axis, wherein:

the mid-inner pin extends about a portion of the innermost pin;

the innermost pin includes a first innermost end contact portion at the first innermost end; and the plug further comprises an overmold of nonconductive material disposed about the first outer end contact portion, the first inner end contact portion, the first mid-inner end contact portion, and the first innermost end contact portion.

31. The plug of claim 30, wherein the maximum diameter of the plug is 3.5 millimeters without the overmold.

32. The plug of claim 30, wherein the maximum diameter of the plug with the overmold is 4.0 millimeters.

33. The plug of claim 24, wherein a plane that is perpendicular to the longitudinal axis intersects the first outer end contact portion and the first inner end contact portion.

34. The plug of claim 24, wherein the first outer end contact portion extends a first distance beyond the first inner end contact portion in a first direction parallel to the longitudinal axis.

35. The plug of claim 24, wherein the longitudinal axis does not intersect any portion of the outer pin.

36. The plug of claim 24, wherein the shortest distance between the first inner end contact portion and the longitudinal axis is equal to the shortest distance between the first outer end contact portion and the longitudinal axis.

37. The plug of claim 24, wherein the shortest distance between the first inner end contact portion and the longitudinal axis is greater than the shortest distance between the first outer end contact portion and the longitudinal axis.

38. A method for assembling a plug having a longitudinal axis, the method comprising:

inserting an outer pin having a first outer end and a second outer end opposite the first outer end at least partially within an outermost pin having a first outermost end and a second outermost end opposite the first outermost end;

inserting an inner pin at least partially within the outer pin; and inserting an innermost pin at least partially within the inner pin, wherein:

the first outer end of the outer pin comprises a first outer contact portion facing away from the longitudinal axis;

the first outermost end of the outermost pin comprises a first outermost contact portion facing towards the longitudinal axis;

the first outermost contact portion extends a first distance beyond the first outer contact portion in a first direction parallel to the longitudinal axis; and the first outer contact portion is one of farther away from and the same distance from the longitudinal axis as the first outermost contact portion is from the longitudinal axis.

39. The method of claim 38, further comprising disposing nonconductive material between the innermost pin, the inner pin, and the outer pin.

40. The method of claim 39, wherein the nonconductive material is polypropylene.

41. The method of claim 39, further comprising disposing additional nonconductive material about at least a portion of the innermost pin, at least a portion of the inner pin, the first outer contact portion, and the first outermost contact portion.

42. The method of claim 38, wherein the outer pin and the outermost pin are centered about the longitudinal axis.

43. The method of claim 42, wherein the first outer contact portion is the same distance from the longitudinal axis as the first outermost contact portion.

44. The method of claim 38, wherein the maximum diameter of the plug is 4.0 millimeters.

45. The method of claim 38, wherein the maximum diameter of the plug is 3.5 millimeters.

* * * * *